United States Patent [19]

Megusar et al.

[11] Patent Number: 4,865,652

[45] Date of Patent: Sep. 12, 1989

[54] METHOD OF PRODUCING TITANIUM-MODIFIED AUSTENITIC STEEL HAVING IMPROVED SWELLING RESISTANCE

[75] Inventors: Janez Megusar, Belmont; Nicholas J. Grant, Winchester, both of Mass.

[73] Assignee: Massachusetts Institute of Technology, Cambridge, Mass.

[21] Appl. No.: 211,341

[22] Filed: Jun. 24, 1988

[51] Int. Cl.[4] ..... C21D 8/00; C21D 8/10; B06B 3/00

[52] U.S. Cl. ..... 148/3; 148/12 E; 148/12.1; 148/325; 264/23; 264/120; 419/39; 75/950

[58] Field of Search ..... 148/3, 12 E, 12.1, 325; 419/39; 264/120, 23; 75/950

[56] References Cited

U.S. PATENT DOCUMENTS

| | | | |
|---|---|---|---|
| 3,384,476 | 5/1968 | Egnell | 148/12 E |
| 3,573,109 | 3/1971 | Levy | 148/12 E |
| 4,325,895 | 4/1982 | Morris | 264/23 |
| 4,421,572 | 12/1983 | Bates et al. | 148/12 E |
| 4,693,864 | 9/1987 | Lloyd | 419/39 |

OTHER PUBLICATIONS

Megusar et al., J. Nuc. Mat., 103 & 104: 961–66 (1981).
Imeson et al., J. Nuc. Mat., 122 & 123: 266–71 (1984).

*Primary Examiner*—Upendra Roy

[57] ABSTRACT

A process for improving the swelling resistance of a titanium-modified austenitic stainless steel that involves a combination of rapid solidification and dynamic compaction techniques.

10 Claims, 2 Drawing Sheets

METHOD OF PRODUCING TITANIUM-MODIFIED AUSTENITIC STEEL HAVING IMPROVED SWELLING RESISTANCE

BACKGROUND OF THE INVENTION

This invention relates to processing steels.

Titanium-modified austenitic stainless steels have been used to fabricate nuclear reactor components. One problem with such steels, however, is that they tend to swell, thereby decreasing the service life of the component and limiting efficient operation of the nuclear reactor. One approach to increasing swelling resistance has been to process the steels using conventional ingot casting followed by hot forging and rolling, solution annealing, and cold rolling. A second approach has been to process the steels using rapid solidification techniques followed by cold rolling.

SUMMARY OF THE INVENTION

In general, the invention features a process for improving the swelling resistance of a titanium-modified austenitic stainless steel that includes the steps of (a) rapidly solidifying the steel under conditions sufficient to increase the amount of carbon and titanium in the austenitic matrix of the steel relative to the amount in the austenitic matrix of the steel prior to the rapid solidification step; and (b) dynamically compacting the rapidly solidified steel under conditions sufficient to deform the microstructure of the austenitic matrix and to retain the increased amount of carbon and titanium achieved during the rapid solidification step in the austenitic matrix.

In preferred embodiments, the titanium content of the steel following dynamic compaction exceeds 0.32 weight percent and preferably is equal to the solid solubility limit of titanium in the rapidly solidified austenitic matrix. The carbon content of the steel following dynamic compaction preferably exceeds 0.046 weight percent, and more preferably is equal to the solid solubility limit of carbon in the rapidly solidified austenitic matrix. The weight to weight ratio of titanium to carbon in the steel following dynamic compaction preferably is substantially the same as the ratio prior to rapid solidification.

In other preferred embodiments, the austenitic matrix is deformed during the dynamic compaction step to the extent that the hardness of the steel is at least 440 knoop. The preferred cooling rate during the rapid solidification step is at least $10^{5}$° C./sec. The density of the steel following dynamic compaction preferably is at least 99% of the theoretical density.

The invention provides titanium-modified austenitic steels having improved swelling resistance. Void formation that would limit the lifetime of a reactor component fabricated from the steel is suppressed.

Other features and advantages of the invention will be apparent from the following description of the preferred embodiments thereof and from the claims.

BRIEF DESCRIPTION OF THE FIGURES

We first briefly describe the drawings.

DESCRIPTION OF THE PREFERRED EMBODIMENTS

Titanium-modified austenitic steels having improved sweling resistance are prepared by rapid solidification followed by dynamic compaction. In general, the steel (also referred to as Prime Candidate Alloy) is remelted to increase the carbon content from about 0.046 weight percent to about 0.15 weight percent and the titanium content from about 0.32 weight percent to about 0.9 weight percent. Melt-spun ribbons of the steel are then prepared and rapidly solidified, e.g., by roller quenching at a cooling rate of at least $10^{5}$° C./sec to retain carbon and titanium in the austenite matrix. Next, the ribbons are chopped into fine particles and dynamically compacted by passing shock waves through the particles to form the final steel product.

Rapid solidification processing leads to higher amounts of titanium and carbon in the austenite matrix compared to conventional processing by increasing the solid solubility limits of these elements in the austenite matrix. The extent of the increase is related to the cooling rate; generally, the higher the cooling rate, the higher the solid solubility limits and, consequently, the higher the amounts of titanium and carbon that can be included in the austenite matrix. The preferred cooling rate is at least $10^{5}$° C./sec.

Dynamic compaction creates bonds between the steel particles without affecting the internal structure of the particles. This leads to a highly deformed microstructure (e.g., a microstructure having high levels of dislocation and twin densities) in which the increased titanium and carbon levels achieved by rapid solidification processing are retained. One measure of the degree of deformation is the hardness of the resulting steel. In general, steels are produced having hardness values of at least 440 knoop.

The combination of rapid solidification and dynamic compaction leads to titanium-modified austenitic steels having increased levels of titanium and carbon in the austenite matrix that are retained in this matrix. This, in turn, along with the abilitiy to form a highly deformed austenite matrix, leads to improved swelling resistance.

Figure 1:
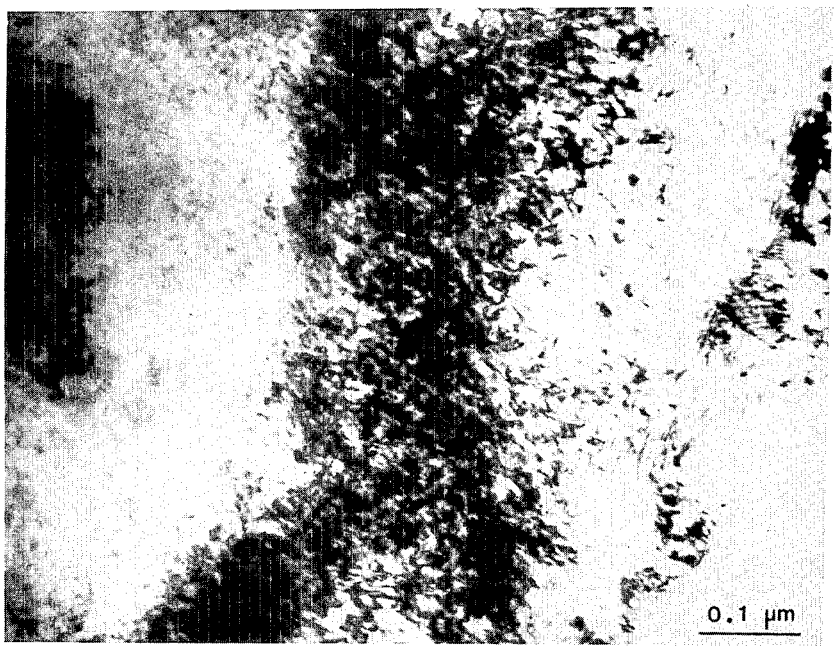
FIGS. 1 and 2 are micrographs showing a rapidly solidified and dynamically compacted titanium-modified austenitic stainless steel.
Figure 3:
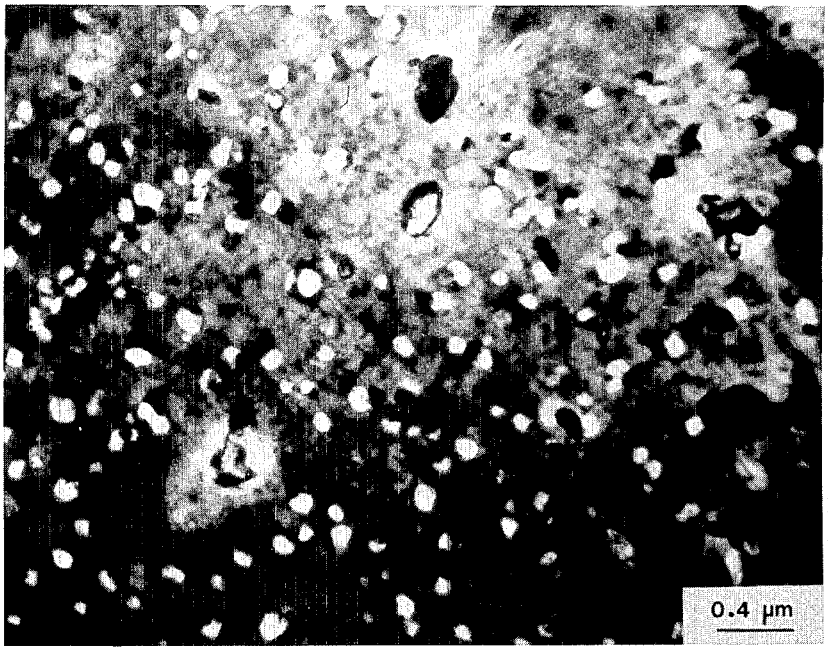
FIG. 3 is a micrograph showing a rapidly solidified and fully recrystallized titanium-modified austenitic stainless steel.
Figure 2:
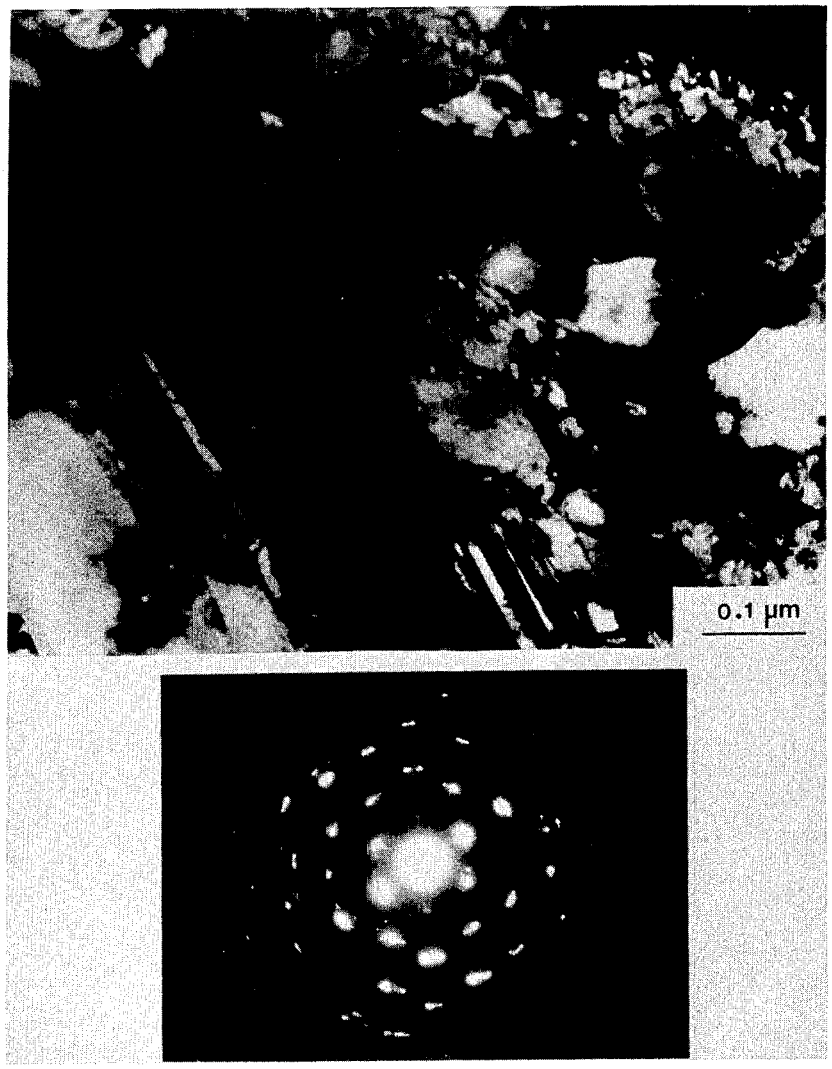

One measure of swelling resistance is the degree of void formation in the steel upon exposure to radiation. As shown in FIGS. 1 and 2, void formation (and thus swelling) in a rapidly solidified and dynamically compacted titanium-modified austenite steel irradiated in an Experimental Breeder Reactor to 15 dpa in the temperature range 395°–550° C. is suppressed. In contrast, the rapidly solidified and fully annealed titanium-modified austenite steel irradiated under the same conditions (FIG. 3) exhibited a high density of voids.

In order to retain the microstructure obtained following dynamic compaction in reactor components manufactured from the steel, the temperature of the environment surrounding the component is preferably maintained at a temperature below the recrystallization temperature of the austenite matrix.

EXAMPLE

A titanium-modified autenitic stainless steel having the following composition (in weight percent) was obtained from Oak Ridge National Laboratory: 16.59 Ni; 14.27 Cr; 1.96 Mo; 0.32 Ti; 1.62 Mn; 0.53 Si; 0.046 C;

0.008 N; 0.04 Co; 0.014 P; 0.002 S; balance Fe. The steel was remelted to approximately triple the nominal amounts of carbon and titanium to 0.17 and 0.92 weight percent, respectively. The melt was then rapidly solidified in a roller quenching apparatus with an estimated cooling rate of $10^{5°}$ C./sec to form foils.

Next, the rapidly solidified foils were dynamically compacted as follows. The foils were cut into pieces with a length to thickness ratio of less than 30:1 and compacted with a gun speed of 1200 m/sec. The diameter of the compacted materials was 5 cm and the height was 1 cm. Compaction was effected by a shock wave produced by the impact of the projectile from the gun on the powder. Calculations showed the following relation between the shock speed, particle velocity, and internal energy: steel powder of approximately 50% loose density compacted to a shock pressure of 5 GPa gave a shock velocity of 1600 m/sec, particle velocity of 800 m/s, and internal energy change of $3\times10^5$J/kg. This energy change corresponds to a temperature rise of 600K. If the energy is considered to be deposited primarily at the powder particle surface, an energy value of $2\times10^4$ J/m$^2$ is obtained.

Other embodiments are within the following claims.

What is claimed is:

1. A process for improving the swelling resistance of a titanium-modified austenitic stainless steel comprising the steps of (a) rapidly solidifying said steel under conditions sufficient to increase the amount of carbon and titanium in the austenitic matrix of said steel relative to the amount in said austenitic matrix prior to said rapid solidification step; and (b) dynamically compacting said rapidly solidified steel under conditions sufficient to deform the microstructure of said austenitic matrix and retain said increased amount of carbon and titanium in said austenitic matrix.

2. The process of claim 1 wherein the titanium content of said steel following said dynamic compaction step is greater than 0.32 weight percent.

3. The process of claim 1 wherein the carbon content of said steel following said dynamic compaction step is greater than 0.046 weight percent.

4. The process of claim 1 wherein said dynamic compaction step deforms said austenitic matrix to the extent that the hardness of said steel following said dynamic compaction step is at least 440 knoop.

5. The process of claim 1 wherein said rapid solidification step comprises cooling a melt of said steel at a rate of at least $10^{5°}$ C./sec.

6. The process of claim 1 wherein the density of said steel following said dynamic compaction step is at least 99% of the theoretical density.

7. The process of claim 1 wherein the weight to weight ratio of titanium to carbon in said steel following said dynamic compaction step is substantially the same as said ratio prior to said rapid solidification step.

8. A steel prepared according to the process of claim 1.

9. The process of claim 2 wherein the titanium content of said steel following said dynamic compaction step is equal to the solid solubility limit of titanium in said rapidly solidified austenitic matrix.

10. The process of claim 3 wherein the carbon content of said steel following said dynamic compaction step is equal to the solid solubility limit of carbon in said rapidly solidified austenitic matrix.

* * * * *

UNITED STATES PATENT AND TRADEMARK OFFICE

CERTIFICATE OF CORRECTION

PATENT NO. : 4,865,652

DATED : September 12, 1989

INVENTOR(S) : Megusar et al.

It is certified that error appears in the above-identified patent and that said Letters Patent is hereby corrected as shown below:

Col. 1, line 6, below "Backgroung of the Invention" insert

--The U.S. Government has rights in this invention pursuant to Contract No. DE-AC02-78ER10107 awarded by the Department of Energy (DOE).--

Signed and Sealed this

Eighth Day of January, 1991

*Attest:*

HARRY F. MANBECK, JR.

*Attesting Officer*

*Commissioner of Patents and Trademarks*